US007471049B2

(12) United States Patent
Savage, Jr. et al.

(10) Patent No.: US 7,471,049 B2
(45) Date of Patent: Dec. 30, 2008

(54) OPTICAL ELEMENT DRIVING CIRCUIT

(75) Inventors: Kenneth E. Savage, Jr., Fitchburg, MA (US); David L. Hendren, Jr., Gardner, MA (US)

(73) Assignee: SimplexGrinnell LP, Westminster, MA (US)

( * ) Notice: Subject to any disclaimer, the term of this patent is extended or adjusted under 35 U.S.C. 154(b) by 216 days.

(21) Appl. No.: 11/479,641

(22) Filed: Jun. 30, 2006

(65) Prior Publication Data

US 2007/0262728 A1 Nov. 15, 2007

Related U.S. Application Data

(63) Continuation of application No. 11/432,120, filed on May 11, 2006.

(51) Int. Cl.
*H05B 37/00* (2006.01)

(52) U.S. Cl. ..... 315/241 P; 315/200 A; 315/241 R

(58) Field of Classification Search ..... 315/209 R, 315/212, 224–225, 241 R, 241 P, 241 S, 291, 315/307, 200 A See application file for complete search history.

(56) References Cited

U.S. PATENT DOCUMENTS

| | | | | |
|---|---|---|---|---|
| 3,864,600 | A | 2/1975 | Schneider | |
| 3,890,536 | A | 6/1975 | Iwata | |
| 3,912,968 | A | 10/1975 | Nakamura | |
| 4,243,917 | A * | 1/1981 | Caprari | 315/241 R |
| 4,393,335 | A * | 7/1983 | Hirata et al. | 315/241 P |
| 4,486,691 | A * | 12/1984 | Beggs | 315/241 P |
| 4,618,803 | A * | 10/1986 | Hardy | 315/241 R |
| 4,656,397 | A | 4/1987 | Chappell et al. | |
| 4,668,935 | A | 5/1987 | McDermott | |
| 4,684,852 | A | 8/1987 | Balogh | |
| 4,839,686 | A | 6/1989 | Hosomizu et al. | |
| 4,853,600 | A * | 8/1989 | Zeltner et al. | 315/241 P |
| 4,900,990 | A * | 2/1990 | Sikora | 315/241 P |
| 4,951,081 | A | 8/1990 | Hosomizu et al. | |
| 4,952,906 | A | 8/1990 | Buyak et al. | |
| 5,111,233 | A | 5/1992 | Yokonuma et al. | |
| 5,128,591 | A | 7/1992 | Bocan | |
| 5,140,226 | A | 8/1992 | Lepper et al. | |
| 5,249,007 | A | 9/1993 | Tanaka | |
| 5,264,895 | A | 11/1993 | Takahashi et al. | |

(Continued)

FOREIGN PATENT DOCUMENTS

DE 40 13 879 A1 10/1991

(Continued)

OTHER PUBLICATIONS

Robert Haver, "Sidac triggers xenon flasher", *Motorola Semiconductor, Phoenix, AZ*, Jun. 14, 1984, 2 pages.

(Continued)

*Primary Examiner*—David H Vu
*Assistant Examiner*—Tung X Le
(74) *Attorney, Agent, or Firm*—Brinks Hofer Gilson & Lione

(57) ABSTRACT

Optical element driving circuits flexibly configure energy sources to cause a flash tube to produce illumination at one of multiple output intensities. The driving circuits allow a single strobe alarm to take the place of multiple strobe alarms individually dedicated to specific output intensities. The driving circuits may also mitigate or eliminate high voltage arcing within the driving circuit.

25 Claims, 10 Drawing Sheets

U.S. PATENT DOCUMENTS

| | | | | |
|---|---|---|---|---|
| 5,313,247 | A | 5/1994 | Hosomizu et al. | |
| 5,432,410 | A * | 7/1995 | Yamada et al. | 315/241 P |
| 5,523,654 | A | 6/1996 | Sikora et al. | |
| 5,530,627 | A | 6/1996 | Morgan | |
| 5,570,077 | A | 10/1996 | Swieboda | |
| 6,031,340 | A | 2/2000 | Brosius | |
| 6,061,528 | A | 5/2000 | Ichihara et al. | |
| 6,243,001 | B1 | 6/2001 | Kodaka | |
| 6,278,382 | B1 | 8/2001 | DeMarco et al. | |
| 6,311,021 | B1 | 10/2001 | Kosich | |
| 6,411,201 | B1 | 6/2002 | Hur et al. | |
| 6,522,261 | B2 | 2/2003 | Scheffler et al. | |
| 6,661,337 | B2 | 12/2003 | Ha et al. | |
| 6,674,247 | B1 * | 1/2004 | Mead et al. | 315/241 P |
| 6,822,400 | B1 | 11/2004 | Ha et al. | |
| 6,856,241 | B1 | 2/2005 | Tice et al. | |
| 2002/0018652 | A1 | 2/2002 | Isozaki et al. | |
| 2005/0128748 | A1 * | 6/2005 | Suwa | 362/253 |

FOREIGN PATENT DOCUMENTS

| | | | |
|---|---|---|---|
| DE | 41 28 551 | A1 | 3/1992 |
| GB | 2 049 318 | A | 12/1980 |
| GB | 2 060 287 | A | 4/1981 |
| GB | 2 117 193 | A | 10/1983 |

OTHER PUBLICATIONS

Rudolf F. Graf, Published by TAB Books, "Hands-on Electronics" Copyright 1991, p. 590.

Rudolf F. Graf and William Sheets, Published by TAB Books, "1992 PE Hobbyist Handbook", Copyright 1995, pp. 6-7.

Rudolf F. Graf and William Sheets, Published by TAB Books, "1991 PE Hobbyist Handbook", Copyright 1995, p. 437.

Edwards Systems Technology, Genesis Speakers and Strobes, Issue 1, Copyright 2002, 4 pages.

Wheelock Inc., Copyright 2002, 4 pages.

Take A Closer Look At Our Select-A-Strobe Family Of Products, May 2000, 2 pages.

Robert Haver, "Sidac triggers xenon flasher", *Motorola Semiconductor, Phoenix, AZ*, Jun. 14, 1984, 2 pages.

Rudolf F. Graf, Published by TAB Books, "Hands-on Electronics" Copyright 1991, p. 590.

Rudolf F. Graf and William Sheets, Published by TAB Books, "1992 PE Hobbyist Handbook", Copyright 1995, pp. 6-7.

Rudolf F. Graf and William Sheets, Published by TAB Books, "1991 PE Hobbyist Handbook", Copyright 1995, p. 437.

American Security Equipment Company, "Select-A-Horn/Strobe Combination", 4 pages No Date.

Edwards Systems Technology, Genesis Speakers and Strobes, Issue 1, Copyright 2002, 4 pages.

EG & G Heimann Optoelectronics, "Flashtubes", 6 pages No Date.

Wheelock Inc., Copyright 2002, 4 pages.

Take A Closer Look At Our Select-A-Strobe Family Of Products, May 2000, 2 pages.

* cited by examiner

OPTICAL ELEMENT DRIVING CIRCUIT

PRIORITY CLAIM

This application is a Continuation of application Ser. No. 11/432,120, filed 11 May 2006, titled "Optical Element Driving Circuit."

BACKGROUND OF THE INVENTION

1. Technical Field

This disclosure relates to optical element driving circuits. In particular, this disclosure is directed to flexible driving circuits which may produce any of multiple different output intensities from a flash tube.

2. Related Art

Visual emergency warning systems, including strobe alarms, have recently incorporated output intensity adjustments. The intensity adjustments allow the warning systems to output light at different intensities, thereby eliminating the need for a manufacturer to produce multiple separate devices each with a fixed output intensity. The ability to adjust the intensity of the light output provides an installer the flexibility to adapt one model of a strobe alarm for many different environments, each of which may call for a different output intensity. To adapt the warning system for any particular environment, an installer configures the strobe alarm (e.g., using a switch or a jumper) at the time of installation to select one of the output intensities that the strobe alarm supports.

Many strobe alarms include basic driving circuits which rely on a step-up transformer to prime a flash tube for illumination and a voltage doubler to start the flash tube. At high candela settings, the high voltages in the driving circuits can cause damaging arcing at and around the flashtube, step-up transformer and the voltage doubler. Therefore, a need exists for an optical element driving circuit that provides the flexibility of different light output intensities and reliable flash tube operation and which also mitigates or eliminates high voltage arcing.

SUMMARY

The present disclosure describes optical element driving circuits. An installer may configure the driving circuits to select a specific output intensity. The driving circuits also exercise intelligent control over the voltages developed to mitigate or eliminate arcing.

In one implementation, an optical element driving circuit includes a first energy source, a second energy source, and trigger input. The trigger input is coupled to an optical element triggering circuit. The optical element driving circuit additionally includes a boost control input and a boost circuit. The boost control input is responsive to a selected output intensity. The boost circuit is selectively configurable in response to the boost control input. In a first circuit configuration, the first energy source, but not the second energy source, drives an optical output element. In a second circuit configuration, the first and second energy sources both drive the optical output element.

In another implementation, an optical element driving circuit includes a first energy source and a second energy source that drive an optical output element. The optical element driving circuit additionally includes a trigger input that is coupled to an optical element trigger circuit. The optical element driving circuit further includes a bypass circuit input and a bypass circuit. The bypass circuit input is responsive to a selected output intensity. The bypass circuit is selectively configurable in response to the bypass circuit input to bypass a voltage control circuit. In a first configuration, the first and second energy sources are charged to substantially the same voltage. In a second configuration, the bypass circuit and the voltage control circuit cause the second energy source to charge to a voltage that is different than the voltage of the first energy source.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The optical element driving circuits can be better understood with reference to the following drawings and description. The components in the figures are not necessarily to scale, emphasis instead being placed upon illustrating the principles of the invention. Moreover, in the figures, like referenced numerals designate corresponding parts or elements throughout the different views.

DETAILED DESCRIPTION OF THE PREFERRED EMBODIMENTS

Figure 1:
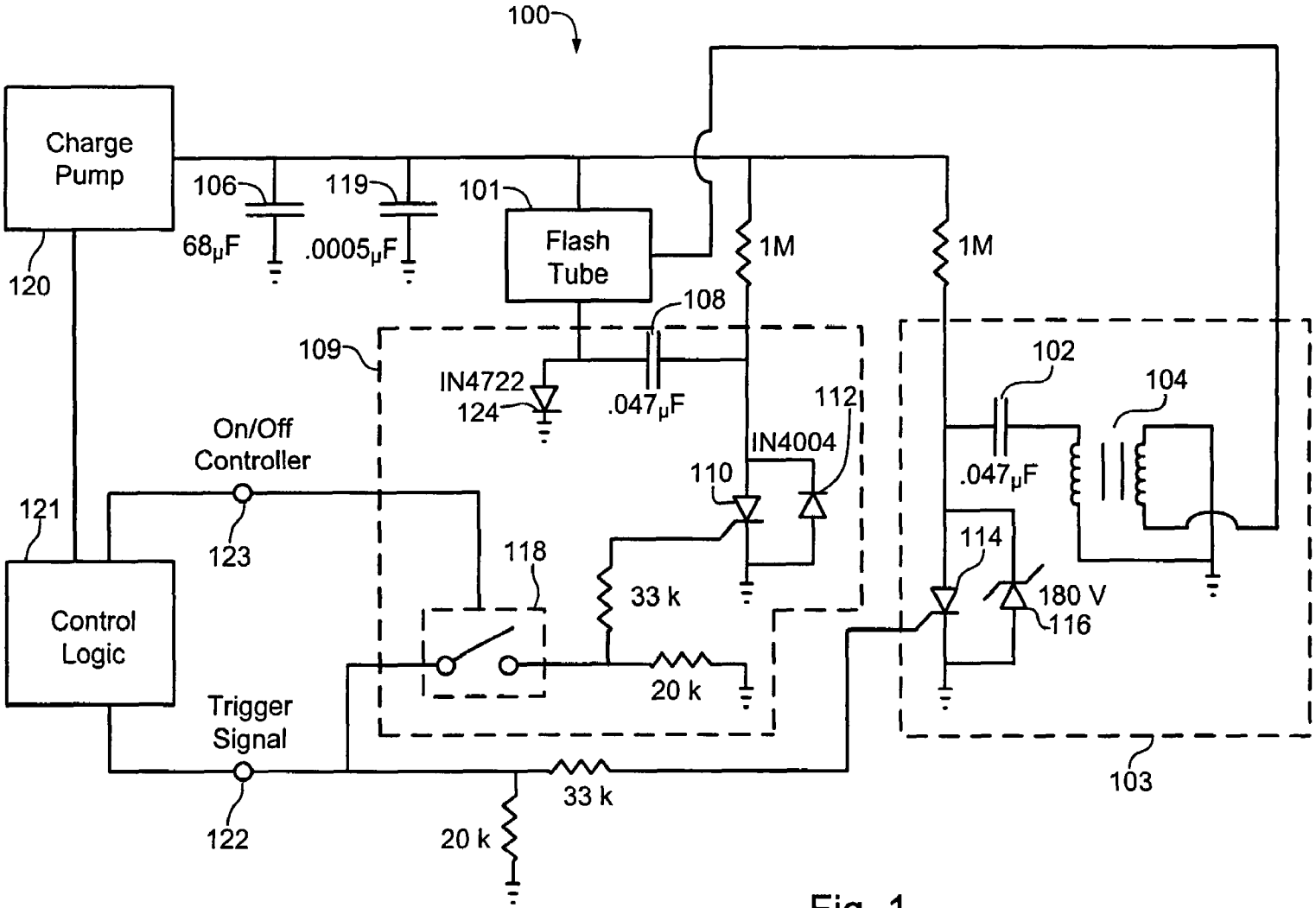
FIG. 1 is a circuit diagram of an optical element driving circuit.

FIG. 1 shows an optical element driving circuit 100 for an optical element 101. In one implementation, the optical element driving circuit 100 is a flash tube driving circuit and the optical element 101 is a flash tube. The optical element driving circuit 100 includes energy sources such as a trigger capacitor 102, an illumination capacitor 106, and a doubling capacitor 108. The optical element driving circuit 100 also includes a step-up transformer 104, a doubling silicon-controlled rectifier ("SCR") 110, a diode 112, a trigger SCR 114, and a trigger zener diode 116. Control logic 121, such as a microcontroller, intelligently controls a switch 118 as will be explained in more detail below. A charge pump 120, or other power supply, charges the trigger capacitor 102, illumination capacitor 106 and doubling capacitor 108. The trigger capacitor 102, step-up transformer 104, and trigger SCR 114 form an optical element triggering circuit 103. The doubling capacitor 108, doubling SCR 110, and switch 118 form a configurable boost circuit 109.

When a trigger signal is applied to a trigger input 122 coupled to the optical element triggering circuit, the flash tube is primed for illumination and one or more energy sources are placed across the flash tube for illumination. Specifically, when a trigger signal is applied to the trigger SCR 114, the energy stored in the trigger capacitor 102 energizes the primary winding of the step-up transformer 104. The secondary of the step-up transformer 104 provides a high voltage output which causes initial ionization of the gas in the flash tube 101 to prime the flash tube for illumination. The trigger signal additionally causes the boost circuit to selectively place the voltage of either the illumination capacitor 106 or both the illumination capacitor 106 and the doubling capacitor 108 across the flash tube 101 for illumination depending on the setting of the switch 118. The switch 118 may be set to place only the illumination capacitor 106 across the flash tube 101 for selected output intensity settings (e.g., high candela settings), while the switch 118 may be set to place both the illumination capacitor 106 and the doubling capacitor 108 across the flash tube 101 for other selected output intensities (e.g., low candela settings).

The charge pump 120 (or other power supply) charges the illumination capacitor 106 and the doubling capacitor 108 to the full voltage selected according to the desired output intensity. For example, for relatively low candela output, the illumination capacitor 106 and the doubling capacitor 108 may be charged to 140 volts for 15 candela output and 185 volts for 30 candela output. Similarly, for relatively high candela output, the illumination capacitor 106 and the doubling capacitor 108 may be charged to 250 volts for 75 candela output and 286 volts for 110 candela output. Any of the voltages, capacitances, or types of energy sources may be modified, adjusted, or substituted to provide any desired set of output intensities.

The charge pump 120 charges the trigger capacitor 102 through a resistor. However, the voltage on the trigger capacitor 102 is controlled by the trigger zener diode 116 so that it does not rise above, for example, 180 volts. As a result, arcing that might ordinarily occur due to the large step-up voltage ratio (e.g., 1 to 36-38) of the transformer 104 may be avoided.

In one implementation, the circuit may additionally include a high frequency filter capacitor 119 connected in parallel with the illumination capacitor 106. The filter capacitor 119 helps to reduce noise in the optical element driving circuit 100. More specifically, the filter capacitor 119 absorbs high frequency transients in the charging pulses that charge the trigger capacitor 102, illumination capacitor 106, and doubling capacitor 108.

The control logic 121 applies a trigger signal at a trigger input 122. In response to the trigger signal, the trigger SCR 114 conducts. When the trigger SCR 114 conducts, a circuit is completed for the trigger capacitor 102 to energize a primary coil of the step-up transformer 104. A secondary coil of the step-up transformer 104 includes one lead connected to ground a second lead connected to the flash tube 101. When the primary coil is energized, the secondary coil generates a damped multi-KV oscillation which is applied to the outside of the flash tube 701. In one implementation, the voltage developed across the pair of leads of the secondary coil has a maximum value of about 5,500 V at 15 candela output to about 6,900 V at 110 candela output. The high voltage output of the transformer secondary coil causes an initial ionization of the gases inside the flash tube 101. The flash tube 101 is then primed for current flow through the tube 101 to generate illumination.

The step-up transformer 104 has a large step-up ratio (e.g., 1 to 36-38) so that the magnitude of a voltage input to the step-up transformer is significantly increased. However, the trigger zener diode 116 controls the voltage on the trigger capacitor 102 so that the step-up transformer 104 does not generate such an excessive voltage that arcing results.

For relatively low candela settings such as 15 and 30 candela, the control logic 121 closes the switch 118. The trigger signal at the trigger input 122 is thereby provided to the doubling SCR 110. When the doubling SCR 110 conducts, the doubling capacitor 108 is placed in series with the illumination capacitor 106 across the flash tube 101. Therefore, even though the doubling capacitor 108 and illumination capacitor 106 are individually charged to a relatively low voltage, that voltage is doubled across the tube to reliably start the tube. The charge on the doubling capacitor 108 dissipates through the doubling SCR 110 and the illumination capacitor 106 discharges through the flash tube 101 and diode 124, causing the flash tube 101 to start and emit light at the selected output intensity.

The diode 112 provides a voltage clamp to prevent voltage oscillations at the doubling capacitor 108 from going too negative. The diode 112 additionally protects the doubling SCR 110 from voltage ringing at the doubling SCR 110. Ringing at the SCR 110 can decrease the normal lifespan of the SCR 110. The diode 112 provides better clamping response than a zener diode and therefore provides increased protection for the SCR 110.

For relatively high candela settings such as 75 or 110 candela, the control logic 121 opens the switch 118. The trigger signal initiates initial ionization in the flash tube 101. The illumination capacitor 106, which has been charged to a voltage high enough to reliably start the tube, dissipates through the flash tube 101 and diode 124 causing the flash tube 101 to start and emit light at the selected output intensity. While the doubling capacitor 108 has been charged to the same voltage as the illumination capacitor 106, the doubling capacitor does not assist with starting the flash tube 101 or delivering illumination energy through the flash tube 101.

As noted above, the control logic 121 selectively opens or closes the switch 118 to intelligently control the voltages applied to the flash tube 101 and the transformer 104 in the circuit 100. When the switch 118 is closed, the trigger signal causes the doubling SCR 110 to conduct and complete a circuit to bring the doubling capacitor 108 in series with the illumination capacitor 106 across the flash tube 101. When the switch 118 is open, there is no path for the trigger signal to reach the doubling SCR 110. Accordingly, the boost circuit is configured to drive the flash tube 101 with the illumination capacitor 106 and not the doubling capacitor 108. The switch 118 may be a manually adjustable circuit, such as a switch, jumper, or other circuit. The switch 118 may also be a transistor, logic gate, or other switch circuit opened or closed under control of the control logic 121.

The optical element driving circuit of FIG. 1 operates in two modes. For relatively low output intensities (e.g., intensities for which the voltage on the illumination capacitor 106 alone may not be sufficient to reliably start the flash tube 101), the boost circuit 109 implements a first circuit configuration in which the optical element driving circuit uses a voltage doubler to drive the flash tube 101 with both the illumination capacitor 106 and the doubling capacitor 108 in series. For relatively high output intensities, both the illumination capacitor 106 and the doubling capacitor 108 are fully charged, but the boost circuit 109 implements a second circuit configuration which drives the flash tube 101 only with the illumination capacitor 106.

Table 1 shows examples of component values for the optical element driving circuit 100. Table 2 shows examples of output intensities and capacitor voltages.

TABLE 1

| Component | Component Value |
|---|---|
| Trigger Capacitor 102 | 0.047 uF |
| Illumination Capacitor 106 | 68 uF |
| Doubling Capacitor 108 | 0.047 μF |
| High Frequency Filter Capacitor 119 | 0.0005 μF |
| Zener diode 116 | 182 V |
| Transformer step-up ratio | 36-38 to 1 |

TABLE 2

| Output Intensity | Illumination Capacitor 106 | Doubling Capacitor 108 | Tube 101 | Trigger Capacitor 102 |
|---|---|---|---|---|
| 15 cd | 144 V | 144 V | 288 V | 144 V |
| 30 cd | 185 V | 185 V | 370 V | 182 V |
| 75 cd | 250 V | 250 V | 250 V | 182 V |
| 110 cd | 286 V | 286 V | 286 V | 182 V |

Figure 2:
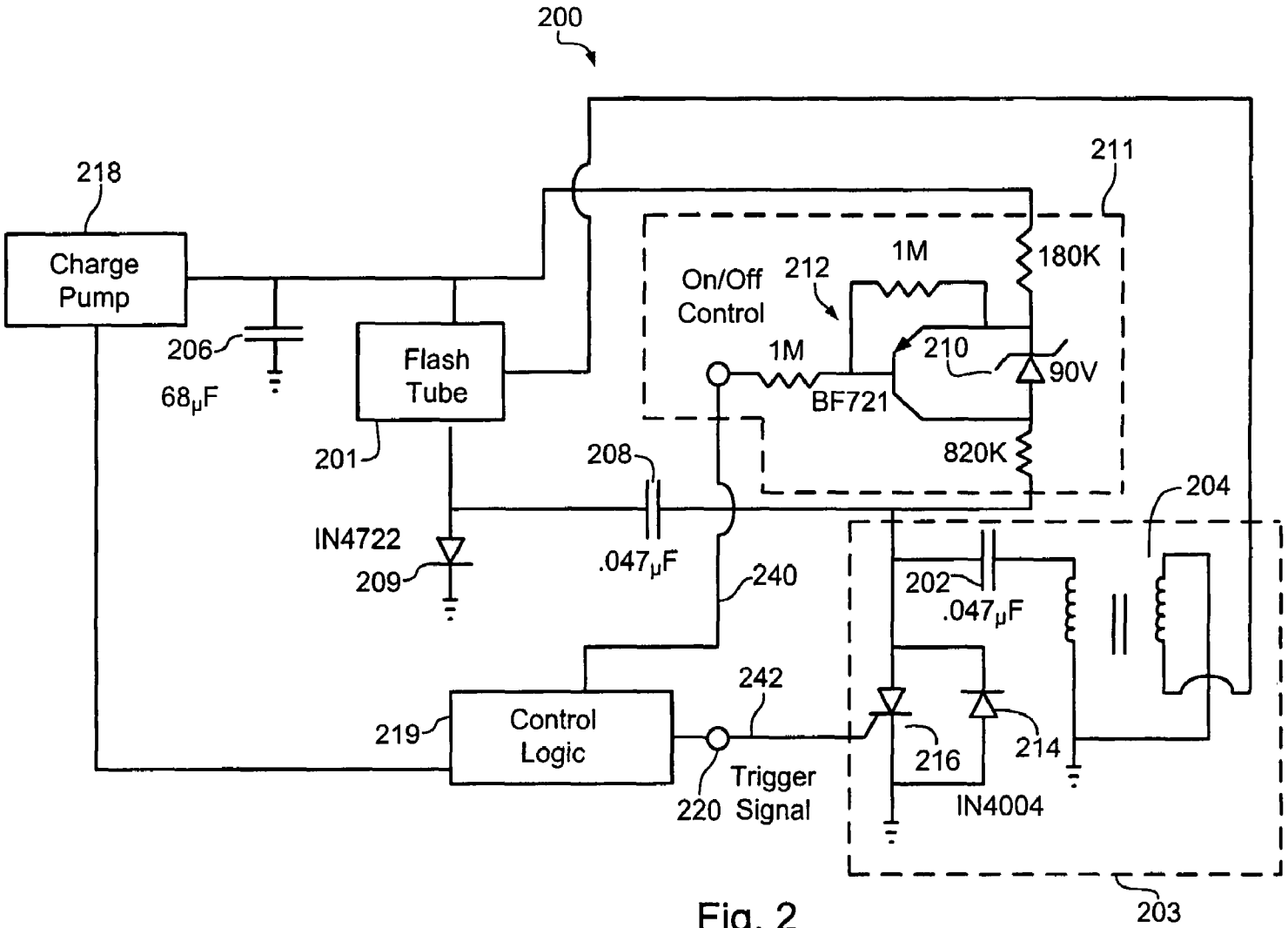
FIG. 2 is a circuit diagram of an optical element driving circuit.

FIG. 2 shows an alternative implementation of an optical element driving circuit 200 for an optical element 201. The optical element driving circuit 200 includes energy sources such as a trigger capacitor 202, an illumination capacitor 206, and a boost capacitor 208, as well as a step-up transformer 204. The circuit 200 also includes a voltage control circuit 211 such as a voltage control zener diode 210 and a bypass circuit 212. The circuit 200 also includes a trigger diode 214, and a trigger SCR 216. The trigger capacitor 202, step-up transformer 204, trigger diode 214, and trigger SCR 216 form an optical element triggering circuit 203.

A charge pump 218 (or other power supply) charges the trigger capacitor 202, illumination capacitor 206, and boost capacitor 208. The charge pump charges the illumination capacitor 206 to the full voltage selected according to the desired output intensity. When the bypass circuit 212 is active, the charge pump charges the boost capacitor 208 and trigger capacitor 202 to the full voltage by providing a current path around the voltage control zener diode 210. When the bypass circuit 212 is inactive, the charge pump charges the boost capacitor 208 and the trigger capacitor 202 to the full voltage minus the voltage across the voltage control zener diode 216.

The bypass circuit 212 may be implemented in many different ways. FIG. 2 shows an example in which the bypass circuit 212 includes a pnp transistor controlled by the applied base voltage. In other implementations, the bypass circuit 212 may employ a Field Effect Transistor (FET), switch, jumper, or other switch circuit to selectively bypass the voltage control zener diode 210.

A trigger signal applied to the trigger SCR 216 causes the energy stored in the trigger capacitor 202 to energize the primary winding of the step-up transformer 204. The secondary winding generates a damped oscillating high voltage signal to perform first stage ionization in the flash tube 201 to prepare for illumination. The SCR 216 additionally places the illumination capacitor 206 and the boost capacitor 208 in series across the flash tube 201. The relatively small amount of energy in the boost capacitor 208 discharges first through the SCR 216. The trigger diode 214 protects the SCR from voltage ringing.

The total voltage provided by the illumination capacitor 206 and the boost capacitor 208 allows the flash tube 201 to start. Accordingly, the illumination capacitor 206 discharges through the flash tube 201 and the diode 209. This discharge produces the selected output intensity. Control logic 219, such as a microcontroller, selectively activates or deactivates the bypass circuit 212 to intelligently control the voltages applied to the flash tube 201 and the transformer 204 in the circuit 200.

For relatively low output intensities such as 15 or 30 candela, doubling the voltage on the illumination capacitor 206 across the flash tube 201 may still result in a total voltage across the flash tube 201 that avoids arcing. Accordingly, the control logic 219 may assert a bypass control signal on the bypass control line 240 to activate the bypass circuit 212. Therefore, the charge pump 218 fully charges the illumination capacitor 206 and the boost capacitor 208 (e.g., to 144 volts for 15 candela, or 185 volts for 30 candela). When the control logic 219 asserts a trigger signal on the trigger control line 242, the illumination capacitor 206 and the boost capacitor 208 are placed in series across the tube. Because both capacitors are charged to the same voltage, the driving circuitry acts as a voltage doubler for the low output intensity modes, and reliably starts the flash tube 201.

For relatively high output intensities, such as 75 or 110 candela, the control logic de-asserts the bypass control signal on the bypass control line 240 to deactivate the bypass circuit 212. The charging path for the boost capacitor 208 and the trigger capacitor 202 therefore includes the voltage control zener diode 210. The charge pump 218 fully charges the illumination capacitor 206 (e.g., to 250 volts for 75 candela or 286 volts for 110 candela). However, the voltage control zener diode 210 controls the voltage on the boost capacitor 208 and the trigger capacitor 202. In particular, the voltage on the boost capacitor 208 and the trigger capacitor 202 charge to the full charging voltage minus the drop (e.g., 90 volts) across the voltage control zener diode.

When the control logic 219 asserts a trigger signal on the trigger control line 242, the illumination capacitor 206 and the boost capacitor 208 are placed in series across the tube. Because the boost capacitor is charged to a lower voltage than the illumination capacitor, less than double the voltage on the illumination capacitor is placed across the tube. Nevertheless, the tube starts reliably because the total voltage is still sufficient to start the tube. Furthermore, because the trigger capacitor voltage is also controlled, the high voltage oscillation applied from the transformer secondary has a lower maximum value than it otherwise would. The voltage control zener diode thereby helps to prevent two types of high voltage arcing in the circuit 200: arcing from the total voltage applied to the flash tube 201, and arcing from the high voltage secondary winding of the transformer 204.

The optical element driving circuit 200 operates in two modes. In a low output intensity mode, the charge pump fully charges the illumination capacitor 206 and the doubling capacitor 208. In the low intensity mode, the optical element driving circuit 200 uses a voltage doubler to place both the illumination capacitor 206 and the doubling capacitor 208 in series across the flash tube 201 when the optical element driving circuit 200 is triggered. In a high output intensity mode, the charge pump fully charges the illumination capacitor 206, but the voltage control zener diode 210 controls the voltage on the boost capacitor 208. When the optical element driving circuit 200 is triggered, the optical element driving circuit 200 places both the illumination capacitor 206 and the boost capacitor 208 in series across the flash tube, but less than double the voltage on the illumination capacitor is applied to the flash tube 201

Table 3 shows examples of component values for the optical element driving circuit 200. Table 4 shows examples of output intensities and capacitor voltages

TABLE 3

| Component | Component Value |
|---|---|
| Trigger Capacitor 202 | 0.047 μF |
| Illumination Capacitor 206 | 68 μF |
| Boost Capacitor 208 | 0.047 μF |
| Voltage Control Zener Diode 210 | 90 V |
| Transformer step-up ratio | 36-38 to 1 |

TABLE 4

| Output Intensity | Illumination Capacitor 206 | Doubling Capacitor 208 | Tube 201 | Trigger Capacitor 202 |
|---|---|---|---|---|
| 15 cd | 144 V | 144 V | 288 V | 144 V |
| 30 cd | 185 V | 185 V | 370 V | 185 V |
| 75 cd | 250 V | 160 V | 410 V | 160 V |
| 110 cd | 286 V | 196 V | 482 V | 196 V |

Figure 3:
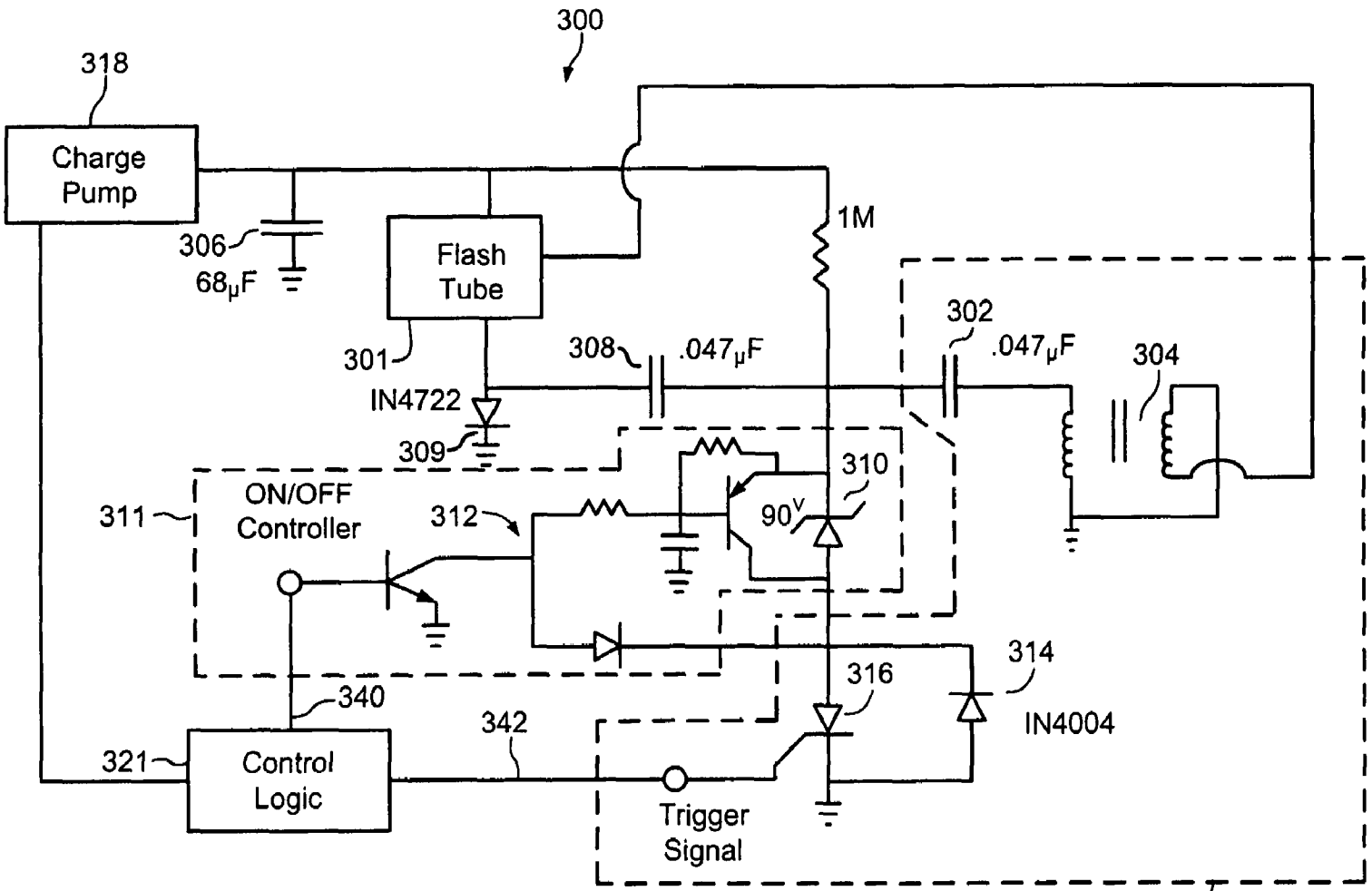
FIG. 3 is a circuit diagram of an optical element driving circuit.

FIG. 3 shows an alternative implementation of an optical element driving circuit 300 for an optical element 301. The optical element driving circuit 300 includes energy sources such as a trigger capacitor 302, an illumination capacitor 306, and a boost capacitor 308. The circuit 300 also includes a voltage control circuit 311. In the example shown in FIG. 3, the voltage control circuit 311 includes a voltage control zener diode 310 and a bypass circuit 312. The trigger capacitor 302, step-up transformer 304, and trigger SCR 314 form an optical element triggering circuit 303.

A charge pump 318 (or other power supply) charges the trigger capacitor 302, illumination capacitor 306, and boost capacitor 308. The charge pump charges the trigger capacitor 302, illumination capacitor 306, and boost capacitor 308 to the full voltage determined by the control logic 321 according to the desired output intensity. When the control logic 321 activates the bypass circuit 312 and when the trigger event occurs, the full voltage is applied from the boost capacitor 308 and the trigger capacitor 302 by providing a current path around the voltage control zener diode 310. When the control logic 321 deactivates the bypass circuit 312 and when the trigger event occurs, the full voltage to which the boost capacitor 308 and the trigger capacitor 302 were originally charged is effectively reduced by an amount equal to the voltage drop across the control zener diode 310. Accordingly, the total voltage across the flash tube is less than double the voltage on the illumination capacitor 306, and the high voltage on the transformer secondary is controlled to help prevent arcing.

The bypass circuit 312 may be implemented in many different ways. FIG. 3 shows an example in which the bypass circuit 312 includes a pnp transistor controlled by the applied base voltage. In other implementations, the bypass circuit 312 may employ a Field Effect Transistor (FET), switch, jumper, or other switch circuit to selectively bypass the voltage control zener diode 310.

Control logic 321, such as a microcontroller, selectively activates or deactivates the bypass circuit 312 to intelligently control the voltages applied to the flash tube 301 and the transformer 304 in the circuit 300. For relatively low output intensities (e.g., 15 cd or 30 cd), the charge pump charges the trigger capacitor 302, illumination capacitor 306, and boost capacitor 308 to the full voltage provided by the charge pump 318 (e.g., 144 V for 15 cd or 185 V for 30 cd). The control logic 321 activates the bypass circuit 312 to provide a current path around the voltage control zener diode 310. A trigger signal then causes the energy stored in the trigger capacitor 302 to energize the primary winding of the step-up transformer 304. The secondary winding generates a damped oscillating high voltage signal to perform first stage ionization in the flash tube 301 to prepare for illumination. The SCR 316 additionally places the illumination capacitor 306 and the boost capacitor 308 in series across the flash tube 301. In this configuration, the circuit 300 implements a voltage doubler to reliably start the flash tube 101.

The total voltage provided by the illumination capacitor 306 and the boost capacitor 308 allows the flash tube 301 to start. The relatively small amount of energy in the boost capacitor 308 discharges first through the SCR 316. The trigger diode 314 protects the SCR 316 from voltage ringing. The illumination capacitor 306 discharges through the flash tube 301 and the diode 309. This discharge produces the selected output intensity.

For relatively high output intensities, such as 75 or 110 candela, the control logic 321 de-asserts the bypass control signal on the bypass control line 340 to deactivate the bypass circuit 312. With the bypass circuit 312 deactivated, the charge pump also charges the trigger capacitor 302, illumination capacitor 306, and boost capacitor 308 to the full voltage (e.g., to 250 volts for 75 candela or 286 volts for 110 candela). However, the voltage control zener diode 310 controls the voltage to which the boost capacitor 308 and the trigger capacitor 302 discharge. Specifically, the voltage on the boost capacitor 308 and the trigger capacitor 302 discharge to a voltage no less than the voltage control zener diode voltage.

The trigger signal initiates ionization in the flash tube using the trigger circuit, and places the illumination capacitor 306 and the boost capacitor 308 in series across the flash tube 301. The voltage control zener diode 310 prevents the application of double the voltage of the illumination capacitor 306 across the flash tube 301. Furthermore, because the trigger capacitor voltage is controlled, the high voltage oscillation applied from the transformer secondary has a lower maximum value than it otherwise would. The voltage control zener diode 310 thereby helps to prevent two types of high voltage arcing in the circuit 300: arcing from the total voltage applied to the flash tube 301, and arcing from the high voltage secondary winding of the transformer 304.

For relatively low output intensities, the control logic 321 activates the bypass control line 340. The illumination capacitor 306, boost capacitor 308, and the trigger capacitor 302 charge to the full voltage for the selected output intensity under control of the charge pump 318. When the control logic 321 asserts a trigger signal on the trigger control line 342, the SCR 316 provides a discharge path for the trigger capacitor 302 and causes the illumination capacitor 306 and the boost capacitor 308 to be placed in series across the flash tube 301. Because the boost capacitor 308 is charged to the same voltage as the illumination capacitor 306, the circuit 300 acts as a voltage doubler for the low output intensities to reliably start the flash tube 301.

In summary, the optical element driving circuit 300 operates in two modes. In a low output intensity mode, the charge pump 318 fully charges the illumination capacitor 306, the doubling capacitor 308, and the trigger capacitor 302. In the low intensity mode, the optical element driving circuit 300 implements a voltage doubler to place both the illumination capacitor 306 and the doubling capacitor 308 in series across the flash tube 301 when the optical element driving circuit 300 is triggered. In a high output intensity mode, the charge pump fully charges the illumination capacitor 306, the doubling capacitor 308, and the trigger capacitor 302, but the voltage control zener diode 310 controls the voltage on the boost capacitor 308 and the trigger capacitor 302. When the optical element driving circuit 300 is triggered, the optical element driving circuit 300 places both the illumination capacitor 306 and the boost capacitor 308 in series across the flash tube 301, but less than double the voltage on the illumination capacitor is applied to the flash tube 301

Table 5 shows examples of component values for the optical element driving circuit 300. Table 6 shows examples of output intensities and capacitor voltages.

TABLE 5

| Component | Component Value |
|---|---|
| Trigger Capacitor 302 | 0.047 μF |
| Illumination Capacitor 306 | 68 μF |
| Boost Capacitor 308 | 0.047 μF |
| Voltage Control Zener Diode 310 | 90 V |
| Transformer step-up ratio | 36-38 to 1 |

TABLE 6

| Output Intensity | Illumination Capacitor 306 | Doubling Capacitor 308 Pretrigger/ trigger | Tube 301 (During trigger) | Trigger Capacitor 302 Pretrigger/trigger |
|---|---|---|---|---|
| 15 cd | 144 V | 144 V/144 V | 288 V | 144 V/144 V |
| 30 cd | 185 V | 185 V/185 V | 370 V | 185 V/185 V |
| 75 cd | 250 V | 250 V/160 V | 410 V | 250 V/160 V |
| 110 cd | 286 V | 286 V/196 V | 482 V | 286 V/196 V |

Figure 4:
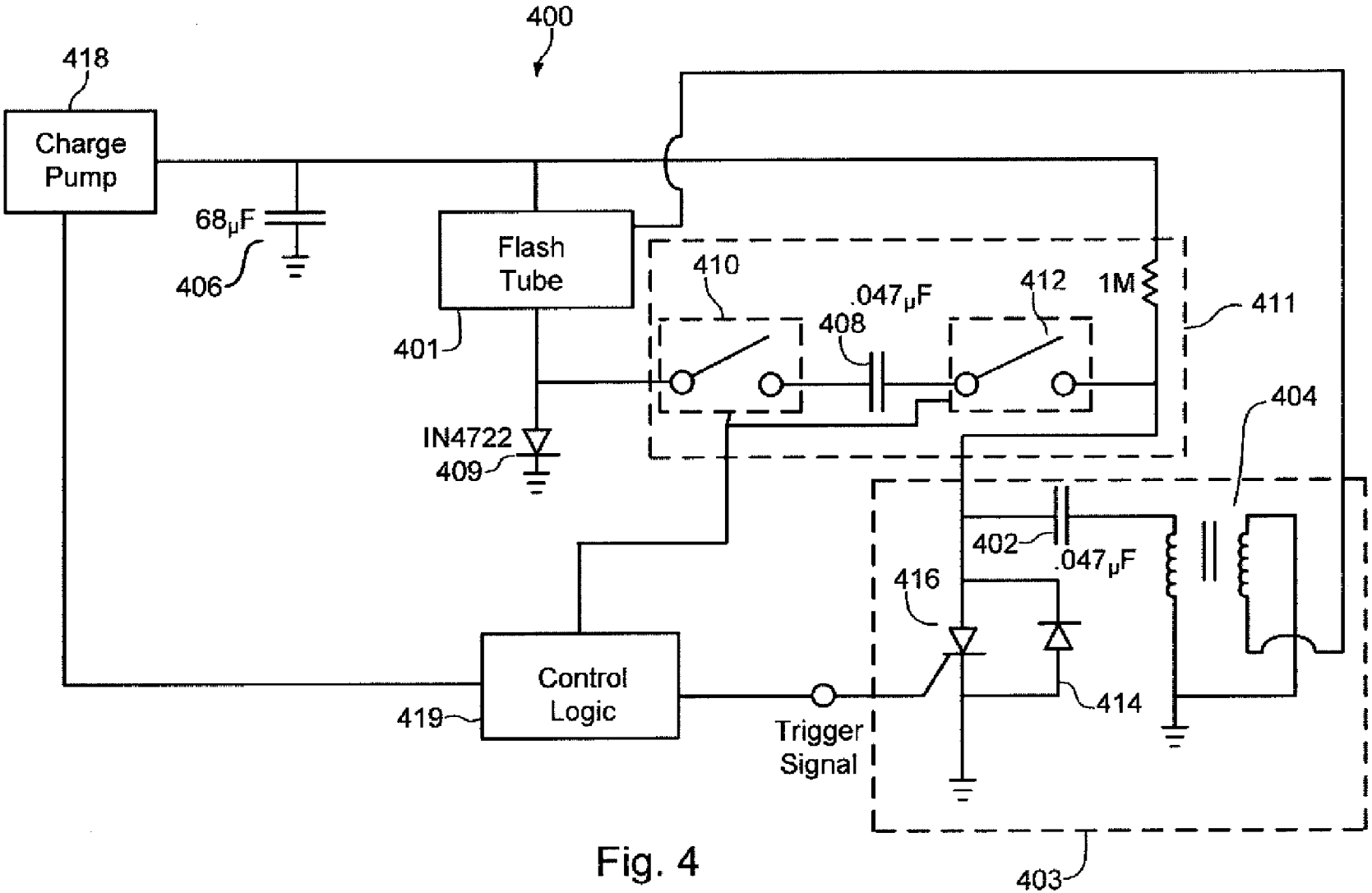
FIG. 4 is a circuit diagram of an optical element driving circuit.

FIG. 4 shows an alternative implementation of an optical element driving circuit 400 for an optical element 401. The optical element driving circuit 400 includes energy sources such as a trigger capacitor 402, an illumination capacitor 406, and a doubling capacitor 408. The circuit 400 also includes a first switch 410, a second switch 412, a trigger diode 414, and a trigger SCR 416. The trigger capacitor 402, step-up transformer 404, and trigger SCR 416 form an optical element triggering circuit 403. Further, the first and second switches 410, 412 form a boost circuit.

A charge pump 418 (or other power supply) charges the trigger capacitor 402, illumination capacitor 406, and boost capacitor 408. The charge pump 418 charges the illumination capacitor 406 to the full voltage selected according to the desired output intensity. When the first and second switches 410, 412 are closed, the charge pump charges the doubling capacitor 408 to the full voltage selected according to the desired output intensity. When at least one of the first and second switches 410, 412 are open, the charge pump 418 does not charge the doubling capacitor 408.

The first and second switches 410, 412 may be implemented in many ways. In other implementations, the first and second switches 410, 412 may be a pnp transistor, a Field Effect Transistor (FET), jumper, relay, or other switch circuit to selectively remove the doubling capacitor 408 from the optical element driving circuit 400. Furthermore, both switches 410 and 412 need not be provided. Instead, a single switch (e.g., switch 410 or switch 412 alone) may connect or disconnect the doubling capacitor 408 in the driving circuit 400.

Control logic 419, such as a microcontroller, selectively activates or deactivates the first and second switches 410, 412 to intelligently control the voltages applied to the flash tube 401. A trigger signal applied to the trigger SCR 416 causes the energy stored in the trigger capacitor 402 to energize the primary winding of the step-up transformer 404. The secondary winding generates a damped oscillating high voltage signal to perform first stage ionization in the flash tube 401 to prepare for illumination.

The trigger SCR 416 additionally places the illumination capacitor 406, or the illumination capacitor 406 and the doubling capacitor 408, across the flash tube 401. The total voltage provided by the illumination capacitor 406 and the boost capacitor 408 allows the flash tube 401 to start. Accordingly, the illumination capacitor 406 discharges through the flash tube 401 and the diode 409. This discharge produces the selected output intensity.

For relatively low output intensities such as 15 or 30 candela, doubling the voltage on the illumination capacitor 406 may still result in a total voltage across the flash tube 401 that avoids arcing. Accordingly, the control logic 419 may assert a control signal to close the first and second switches 410, 412. Therefore, the charge pump 418 fully charges the illumination capacitor 406 and the doubling capacitor 408 (e.g., to 144 volts for 15 candela, or 185 volts for 30 candela).

When the control logic 419 asserts a trigger signal on the trigger control line 442, the illumination capacitor 406 and the boost capacitor 408 are placed in series across the tube. Because both capacitors are charged to the same voltage, the driving circuitry acts as a voltage doubler for the low output intensity modes, and reliably starts the flash tube 401. The relatively small amount of energy in the boost capacitor 408 discharges first through the SCR 416. The trigger diode 414 is protects the SCR 416 from ringing.

For relatively high output intensities, such as 75 or 110 candela, the control logic 419 asserts a control signal to open at least one of the first and second switches 410, 412, thereby removing the doubling capacitor 408 from the circuit 400. The charge pump 418 fully charges the illumination capacitor 406 (e.g., to 250 volts for 75 candela or 286 volts for 110 candela). However, the charge pump 418 does not charge the doubling capacitor 408. The voltage on the illumination capacitor 406 is sufficient to start the flash tube 401. The energy in the illumination capacitor 406 provides the selected output intensity.

The optical element driving circuit of FIG. 4 operates in two modes. In a low light mode, the optical element driving circuit uses a voltage doubler to place both the illumination capacitor 406 and the doubling capacitor 408 in series across the flash tube 401 at the same time. In a high light mode, only the illumination capacitor 106 is fully charged and placed across the flash tube 401.

Table 7 shows examples of component values for the optical element driving circuit 400. Table 8 shows examples of output intensities and capacitor voltages.

TABLE 7

| Component | Component Value |
|---|---|
| Trigger Capacitor 402 | 0.047 μF |
| Illumination Capacitor 406 | 68 μF |
| Boost Capacitor 408 | 0.047 μF |
| Transformer step-up ratio | 36-38 to 1 |

TABLE 8

| Output Intensity | Illumination Capacitor 406 | Doubling Capacitor 408 | Tube 401 | Trigger Capacitor 402 |
|---|---|---|---|---|
| 15 cd | 144 V | 144 V | 288 V | 144 V |
| 30 cd | 185 V | 185 V | 370 V | 185 V |
| 75 cd | 250 V | — | 250 V | 250 V |
| 110 cd | 286 V | — | 286 V | 286 V |

Figure 5:
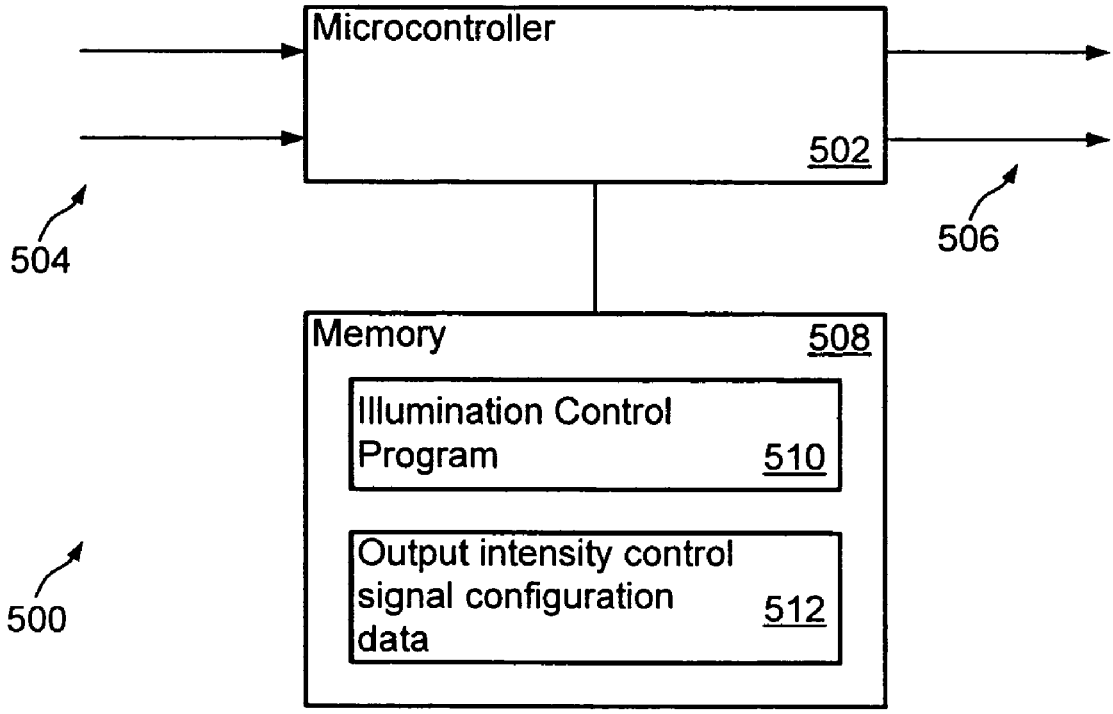
FIG. 5 shows a microcontroller which may control an optical element driving circuit.

FIG. 5 shows control logic 500 in the form of a microcontroller 502 for controlling the optical element driving circuits described above. The microcontroller 502 includes one or more input lines 504 and one or more output lines 506. The microcontroller 502 connects to a memory 508 that stores an illumination control program 510 and configuration data 512. The configuration data 512 may provide a mapping between selected output intensity and whether to assert or de-assert a boost control input, switch control input, bypass control input, or any other output. For example, assuming the control circuit shown in FIG. 1, for 110 cd output intensity, the configuration data 512 may specify that the switch control input 123 should be de-asserted so that only the illumination capacitor 106 drives the flash tube 101.

The microcontroller 502 executes the illumination control program 510 stored in the memory 508. The illumination control program 510 directs the microcontroller 502 to generate control signals on the output lines 506 dependant on signals received on the input lines 504 and the configuration settings in the lookup table 512. For example, the input lines 504 may include a candela selection input line connected to a jumper, switch, or other selector. The candela selection input line provides a selection signal representative of the desired output intensity. The output lines 506 may drive the boost control input, switch control input, bypass control input, trigger input, or any other input to the control circuits in accordance with the selected output intensity.

Figure 6:
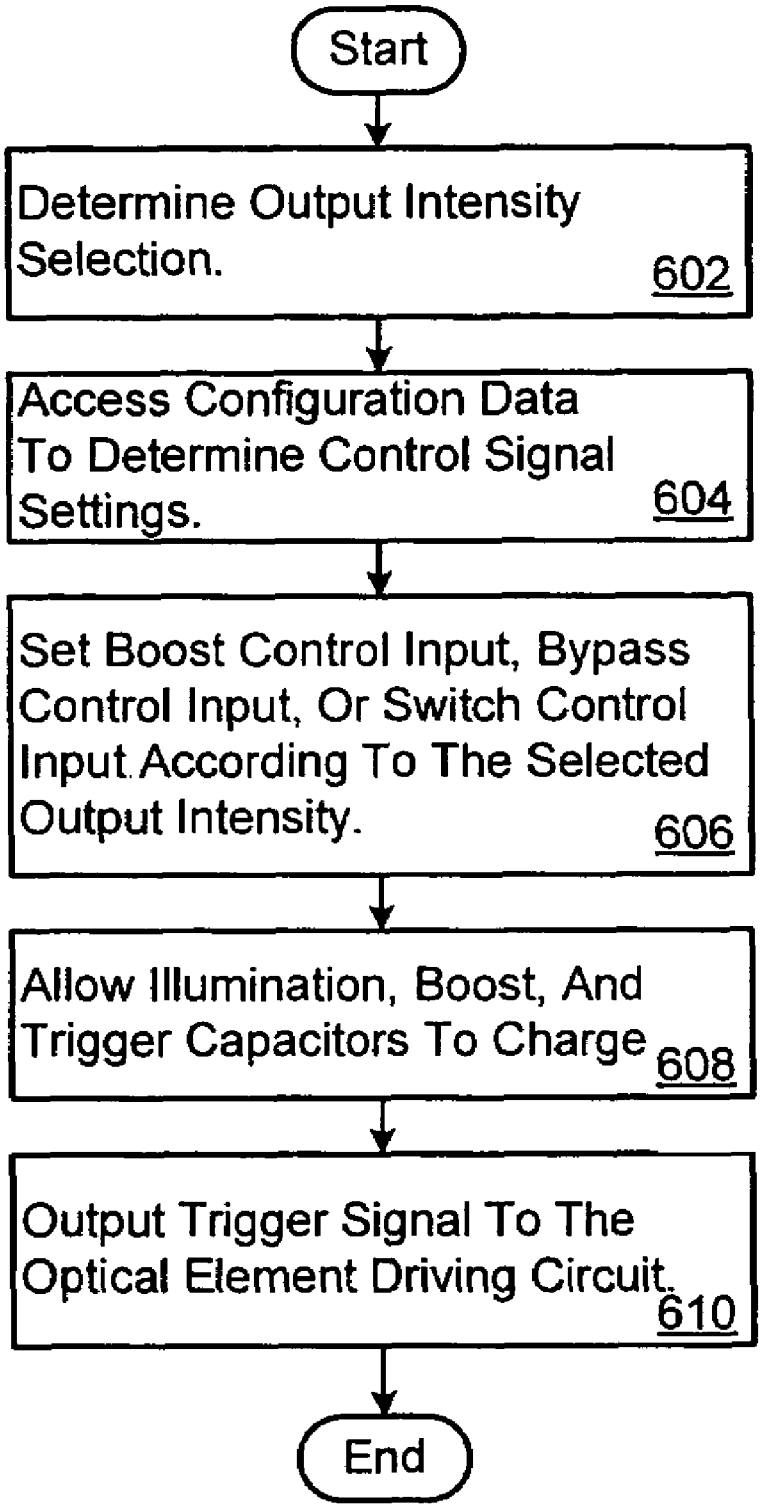
FIG. 6 is a flow diagram of the acts which an illumination control program may take to control the optical element driving circuit.

FIG. 6 is a flow diagram of the acts which the illumination control program 510 may take to control an optical element driving circuit. The illumination control program 510 determines the desired output intensity (Act 602). For example, the illumination control program 510 may read a digital input or an analog voltage (e.g., tapped with a jumper on a resistor ladder) to determine the selected output intensity. With the selected output intensity, the illumination control program 510 accesses the configuration data 512 to determine whether to assert or de-assert voltage configuration signals, such as the bypass control input (Act 604). Alternatively, the illumination control program 510 may incorporate logical tests to determine whether to assert or de-assert any particular voltage configuration signal. Thus, the illumination control program 510 outputs the control signals which configure elements such as the switch 118 of FIG. 1, the bypass circuit 212 of FIG. 2, the bypass circuit 312 of FIG. 3, or the first and second switches 410, 412 of FIG. 4 for the selected output intensity (Act 606).

The illumination control program 510 then allows the illumination, boost, and trigger capacitors to charge (Act 608). The illumination control program 510 may then determine when to issue a trigger signal to the driving circuit (Act 610). The trigger signal initiates the ionization of the gas in the flash tube, and the optical output from the flash tube at the selected output intensity.

Figure 7:
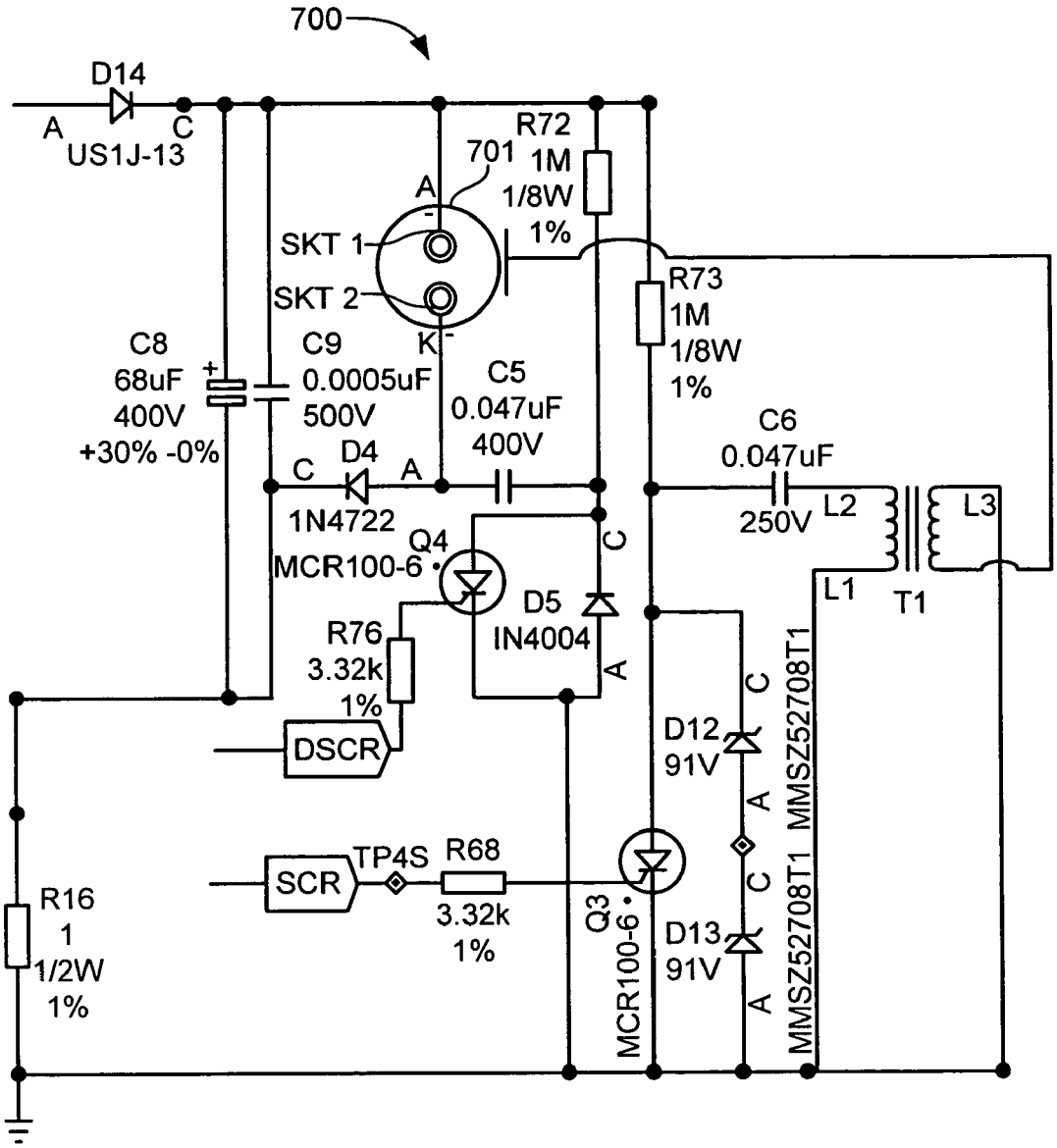
FIG. 7 shows another implementation of the optical element driving circuit shown in FIG. 1.

FIG. 7 shows a specific implementation of the driving circuit presented in FIG. 1. The driving circuit 700 produces illumination from the flash tube 701 at one of four different output intensities. A 2-pin jumper may be used to select the intensity: either 15 candela, 30 candela, 75 candela, or 110 candela. The output intensity may be set in many different ways, however. For example, the output intensity may be set under software control by local or remote entities in communication with the control circuitry.

The driving circuit 700 includes a trigger capacitor C6 connected to a step-up transformer T1. Two terminals of a flash tube 701 connect to the sockets SKT1 and SKT2. An illumination capacitor C8 and a doubling capacitor C5 are present to drive the flash tube. A high frequency filter capacitor C9 is connected in parallel across C8 to help reduce noise. The high frequency filter capacitor C9 smoothes high frequency transients in the charging pulses which charge the capacitors C5, C6, C8, and C9.

Charging circuitry fully charges the capacitors C5, C8, and C9 to a specific voltage which depends on the selected candela output. In addition, the two series connected 91 V zener diodes D12 and D13 control the voltage on the trigger capacitor C6 so that it does not charge above 182 V. The capacitors C8, C9, and C5 always charge to the full voltage determined by the charging circuit, without limitation. In other words, the capacitors C8, C9, and C5 are never charged to different voltages; they are always charged to the full voltage determined by the charging circuitry. Depending on the selected candela output, the driving circuit 700 either operates in a first mode that applies C8 and C9 to the tube, or in a second mode that doubles the voltage across the tube. The voltage doubler uses C5 in series with C8 and C9. The driving circuit 700 uses the voltages shown below in Table 5.

TABLE 5

| Candela Output | C8/C9 | C5 | Tube | C6 |
|---|---|---|---|---|
| 15 | 144 V | 144 V | 288 V (C8/C9 + C5) | 144 V |
| 30 | 185 V | 185 V | 370 V (C8/C9 + C5) | 182 V |
| 75 | 250 V | 250 V | 250 V (C8/C9) | 182 V |
| 110 | 286 V | 286 V | 286 V (C8/C9) | 182 V |

To prime the tube 701 to provide a light output, the driving circuit 700 provides a trigger signal on the trigger input labeled SCR to trigger the SCR Q3. The trigger signal causes the SCR Q3 to conduct, thereby completing a circuit for the trigger capacitor C6 to energize the primary coil of the step-up transformer T1. The transformer secondary winding includes one lead connected to ground and a second lead connected to the flash tube 701. The transformer secondary winding generates a damped multi-KV oscillation applied to the outside of the tube 701. The voltage developed across the pair of leads in the secondary of the transformer has a maximum value of about 5,500 V at 15 candela output to about 6,900 V at 110 candela output. The high voltage output of the transformer secondary winding causes an initial ionization of the gases inside the tube 701. The tube 701 is then primed for current flow through the tube 701 to generate illumination.

At the 15 candela and 30 candela output intensities, the driving circuit 700 uses a voltage doubler to reliably start the tube and generate the desired light output. At the 15 candela and 30 candela output levels, the driving circuit 700 asserts the doubling input labeled DSCR (at the same time as the input labeled SCR) to trigger the SCR Q4. When Q4 conducts, it brings the previously positive node of C5 to ground, placing C5 across the tube with C8/C9 to double the voltage applied to the tube 701. The diode D4 is temporarily reverse biased. The doubled voltage reliably starts the tube 701, and capacitor C5 quickly discharges through the SCR Q4. The energy in the illumination capacitor C8 then provides the selected light output level as current flows from C8, through the tube 701, and through D4 to ground.

At the 75 candela and 110 candela output intensities, the voltage on the illumination capacitor C8 is sufficient to reliably flash the tube 701. Therefore, in the 75 candela and 110 candela output modes, the driving circuit 700 uses C8/C9 to drive the flash tube 701 without doubling. Though there may be insignificant leakage of C5 through the 1M Ohm resistor R72 through the flash tube 701, it is the voltage on C8/C9 that fires the tube 701 and the energy in C8 that produces the selected output light level. More particularly, at the 75 candela and 110 candela output levels, the driving circuit 700 does not assert the DSCR signal. As a result, the driving circuit 700 applies the voltage of C8/C9 across the flash tube 701 without doubling. The energy in the illumination capacitor C8 provides the selected light output level as current flows from C8, through the tube 701, and through D4 to ground.

In other words, the driving circuit 700 operates in one of two modes. In the low light mode, the driving circuit 700 uses a voltage doubler to simultaneously place C8/C9 and C5 in series across the tube 701. In the high light mode, the driving circuit 700 drives the flash tube 701 using C8/C9 connected across the tube 701. In the high light mode, C5 is charged to the same voltage as C8/C9, but is not used in conjunction with C8/C9 to start the tube 701 or provide illumination.

Figure 8:
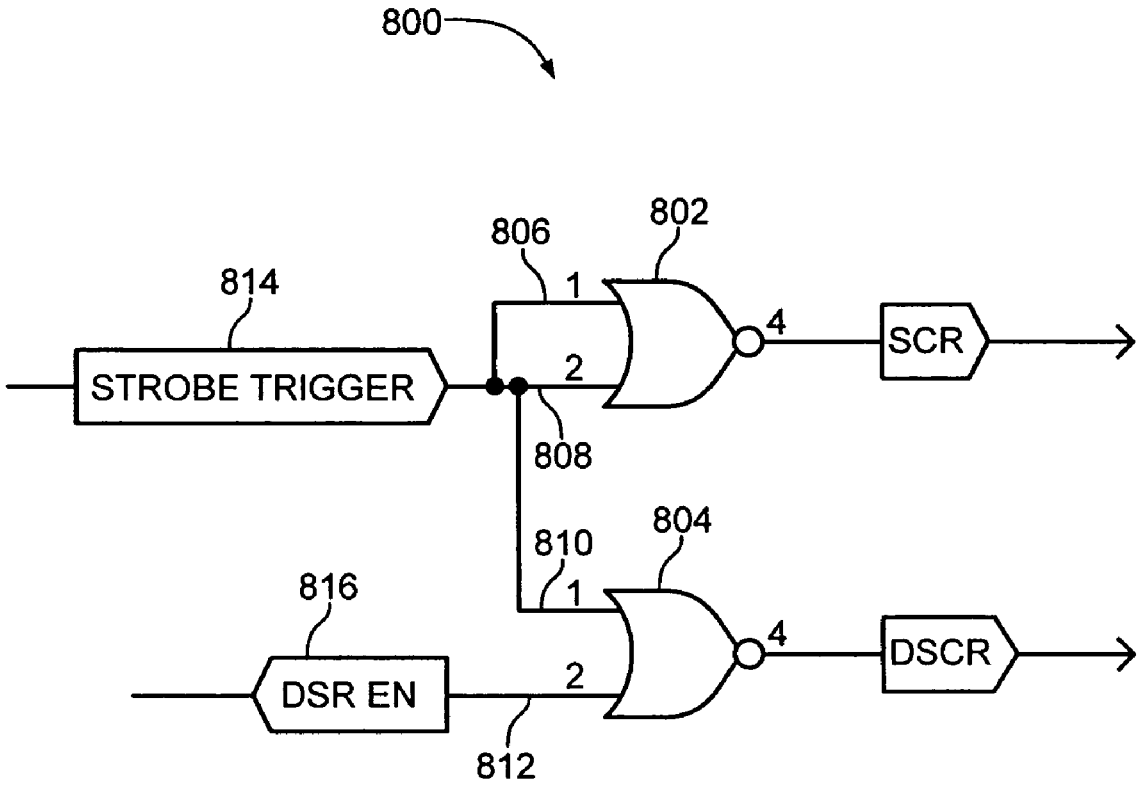
FIG. 8 is a circuit for generating a voltage doubling signal and a trigger signal for the optical element driving circuit shown in FIG. 7.

FIG. 8 is a control circuit 800 for controlling the trigger input and the doubling input connected to the driving circuit 700. The control circuit 800 includes a first NOR gate 802 and a second NOR gate 804. The NOR gates are connected to two inputs. The microcontroller 502 or other control logic may assert or de-assert the inputs to control the voltages developed in the driving circuit 700. The control circuit 800 may be implemented with any other circuitry, and is not limited to an implementation in NOR gates, or hardware.

The first input is a strobe trigger input 814 coupled to a first input 806 and a second input 808 of the first NOR gate 802. The strobe trigger input 814 is additionally coupled to a first input 810 of the second NOR gate 804. The second input is a voltage doubling control input 816 connected to a second input 812 of the second NOR gate 806.

When the strobe trigger input 814 is asserted, the first NOR gate 802 generates a trigger pulse on the trigger output labeled SCR. In response to the trigger signal, SCR Q3 conducts to complete a circuit for the trigger capacitor C6 to energize the primary coil of the step-up transformer T1. When the voltage doubling control input 816 is also asserted, the control circuit 800 generates a trigger pulse on the doubling input DSCR. Otherwise, no trigger pulse is generated on the doubling input DSCR.

At low output intensities (e.g., 15 candela and 30 candela), the voltage doubling control input 816 is asserted. Accordingly, the doubling input DSCR causes Q4 to conduct, thereby placing C5 across the flash tube with C8/C9 to double the voltage applied to the flash tube. At high output intensities (e.g., 75 candela and 110 candela), the voltage doubling control input 816 is not asserted. Accordingly, Q4 does not conduct and the driving circuit uses C8/C9 to drive the flash tube without doubling. While the control circuit 800 has been explained with respect to the optical element driving circuit of FIG. 7, the same control circuit 800 could also be adapted to control, as examples, the bypass control input, boost control inputs, and switch control inputs discussed above with respect to FIGS. 1, 2, 3, and 4.

Figure 9:
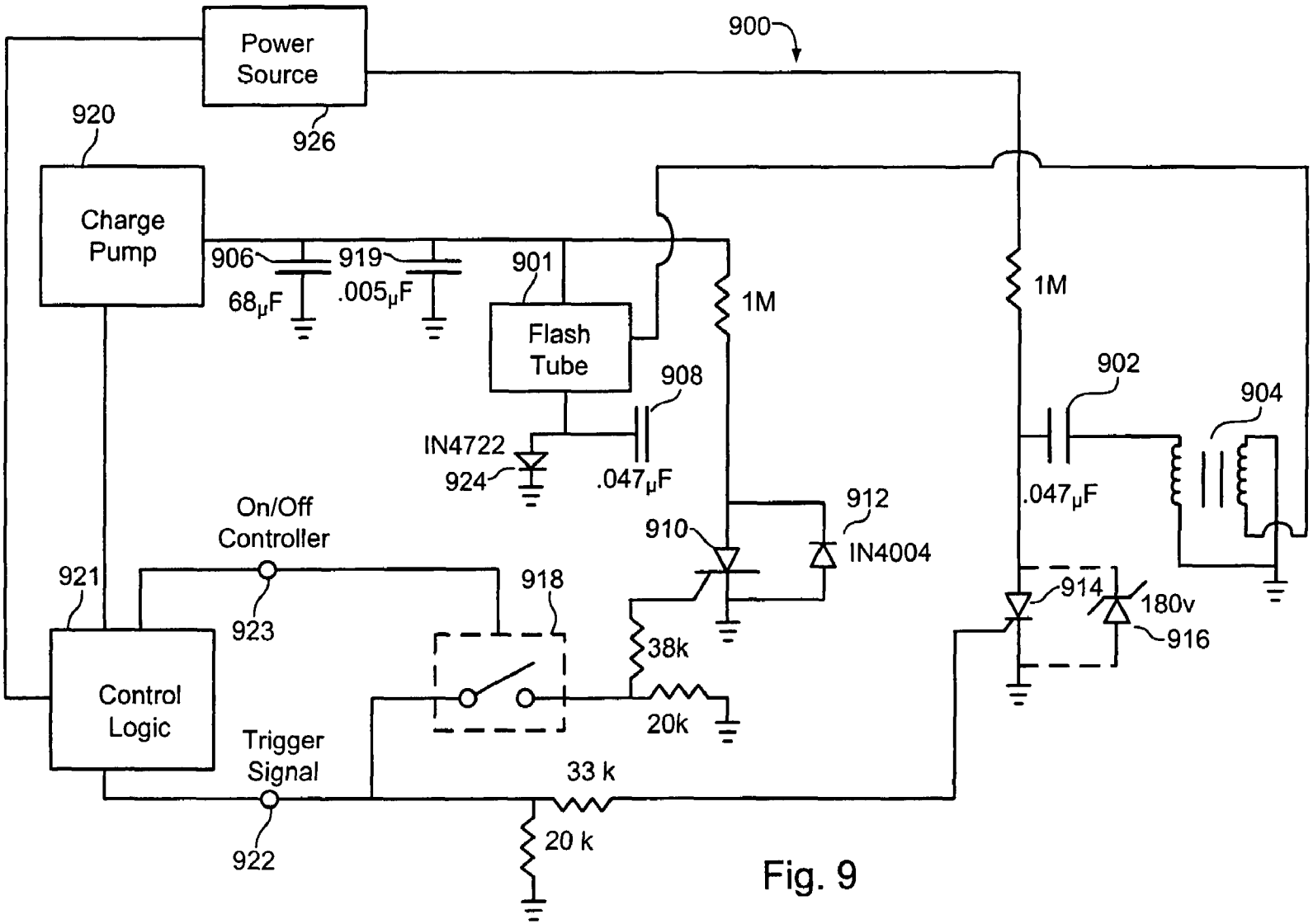
FIG. 9 is a circuit diagram of an optical element driving circuit.

FIG. 9 shows an alternative implementation of an optical element driving circuit 900 for an optical element 901. In FIG. 9, a power source 926 (e.g., an AC or DC voltage source, charge pump, or other power source) charges the trigger capacitor 902. The power source 926 operates independently from the charge pump 920 that charges the illumination capacitor 906 and boost capacitor 908. Accordingly, the control logic 921 may set the voltage on the trigger capacitor 902 independently of the voltage on the illumination capacitor 906 and boost capacitor 908. Additionally or alternatively, a third power source may be provided to independently charge the boost capacitor 908. In other words, the control logic 321 may exercise direct and independent control over the voltage on any of the illumination capacitor 906, boost capacitor 908, and trigger capacitor 902. Accordingly, the control logic 321 may specifically control the voltages to provide a wide range of desired output intensities, while avoid arcing.

As noted above, the power source 926 charges the trigger capacitor 902 to a selected trigger voltage independently of the voltage to which the charge pump 920 charges the illumination capacitor 906 and the doubling capacitor 908. For example, for relatively high candela settings, such as 75 or 110 candela, the power source 926 may charge the trigger capacitor 902 to a relatively low voltage, such as 182 V, while the charge pump 920 independently charges the illumination capacitor 906 and the doubling capacitor 908 to a relatively high voltage, such as 250 V or 286 V. The power source 926 thereby operates as an independent control on the voltage produced by the secondary winding of the transformer 904, helping to prevent arcing at and around the flashtube 901 and the step-up transformer 904.

In the driving circuit 100 of FIG. 1, the trigger zener diode 116 controls the voltage at the trigger capacitor 102. In the implementation shown in FIG. 9, however, the voltage source 926 directly controls the voltage on the trigger capacitor 902. As a result, the trigger zener diode 916 may be omitted (or may be retained as a safeguard against overcharging the trigger capacitor 902). One or more independent power sources for the illumination capacitors, boost capacitors, or trigger capacitors may also be employed in any of the driving circuits explained above.

Figure 10:
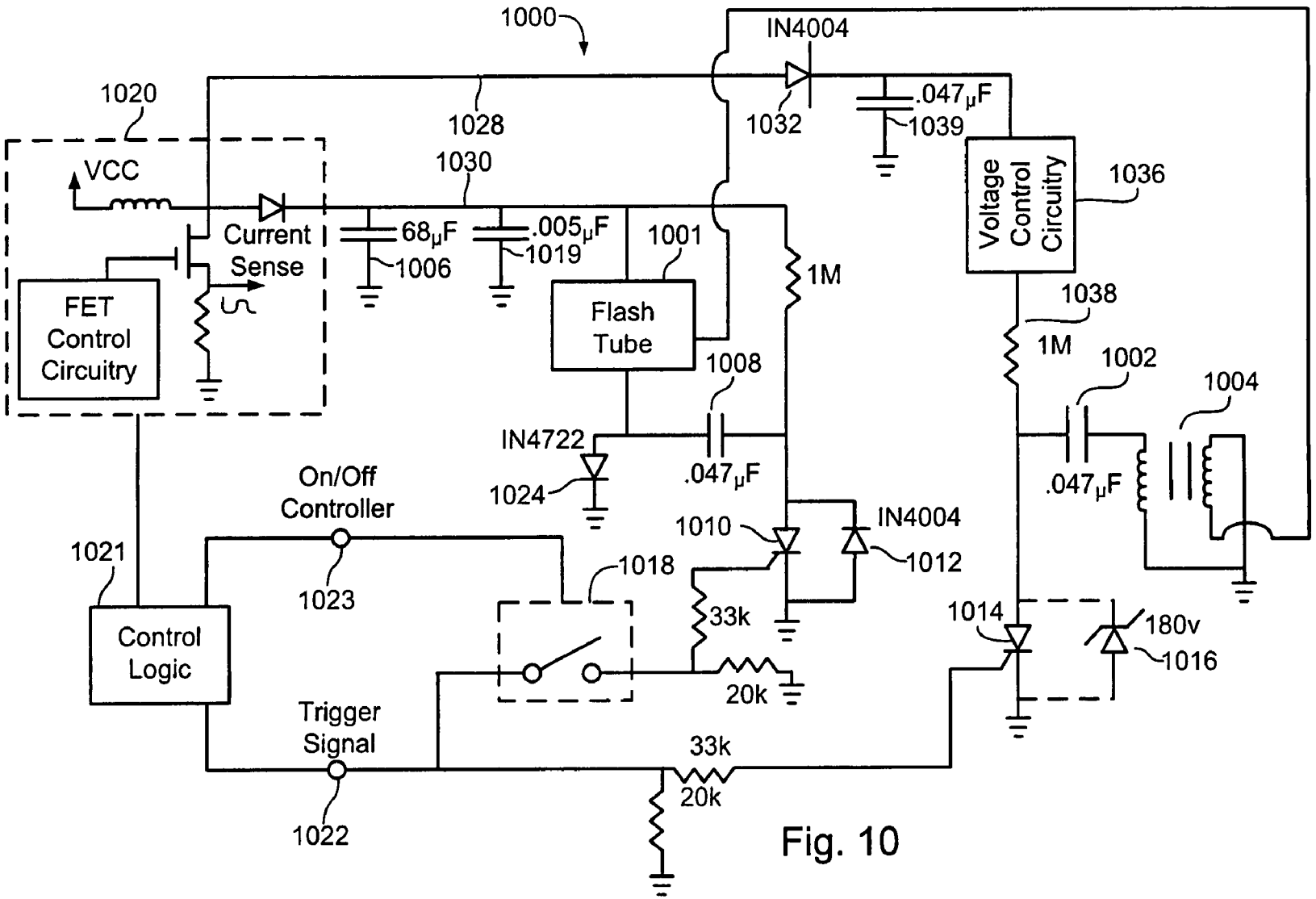
FIG. 10 is a circuit diagram of an optical element driving circuit.

FIG. 10 shows an alternative implementation of an optical element driving circuit 1000 that provides an independent power source for the trigger capacitor 1002. In particular, the driving circuit 1000 includes a PWM charge pump 1020 under control of the control logic 1021. While the driving circuit 100 in FIG. 1 (for example) charged both the trigger capacitor and the illumination capacitor with the same charging output from the charge pump 120, the implementation shown in FIG. 10 splits the charging output into a separate illumination charging output 1030 and a trigger charging output 1028.

As a result, the circuit 1000 may include circuitry connected to the trigger charging output 1028 for independent control over charging the trigger capacitor 1002. As shown in FIG. 10, the charge pump 1020 charges the trigger capacitor 1002 through a diode 1032, a supply capacitor 1034, and a resistor 1038. The diode 1032 allows current pulses to flow from the charge pump 1020 to the supply capacitor 1034 to thereby charge the supply capacitor 1034. The supply capacitor 1034 provides a stable voltage source that charges the trigger capacitor 1002 through the relatively large 1M Ohm resistor 1038.

The driving circuit 1000 optionally includes voltage control circuitry 1036 connected to the trigger charging output 1028. The voltage control circuitry 1036 helps to set the voltage to which the trigger capacitor 1002 charges. For example, the voltage control circuitry 1036 may include a zener diode, or any other circuitry that boosts or reduces the voltage to which the trigger capacitor 1002 charges. The voltage control circuitry 1036 may be used in addition to or as an alternative to the trigger zener diode 1016. While FIG. 10 shows a modified version of the driving circuit 100, an independent illumination charging output and trigger charging output may be provided in any of the driving circuits explained above.

The disclosed driving circuits may be modified and still fall within the spirit of the disclosure. For example, the bypass circuits may be implemented with other types of transistors, such as field effect transistors, with switches, jumpers, relays, or other circuits. The flash tube may be any source of illumination (or energy output in the visible or non-visible spectrum), including a Xenon flash tube or other light source. The zener diodes voltages may vary to accommodate any particular design or application. The driving circuit may produce output intensities other than 15, 30, 75, and 110 candela. Batteries, or other energy sources, may be used in addition to or as alternative to the capacitors, while other types of switches may be used instead of SCRs. The charge pump may be implemented with another type of power supply. The control circuitry may be analog or digital control circuitry, including discrete circuits, processors operating under programmed control, or other circuitry. It is therefore intended that the foregoing detailed description be regarded as illustrative rather than limiting, and that it be understood that it is the following claims, including all equivalents, that are intended to define the spirit and scope of this disclosure.

The invention claimed is:

1. An optical element driving circuit comprising:
an illumination capacitor;
a doubling capacitor;
a flash tube coupled to the illumination capacitor;
an output intensity selector operable to select between a high light mode and a low light mode;
a voltage doubling control input responsive to the output intensity selector; and
a control circuit coupled to the voltage doubling control input and operable to selectively connect the illumination capacitor and the doubling capacitor in series with the flash tube under the low light mode.

2. The optical element driving circuit of claim 1, further comprising:
a trigger input coupled to the control circuit; and
where the control circuit is further operable to selectively connect the illumination capacitor and the doubling capacitor in series under control of both the trigger input and the voltage doubling control input.

3. The optical element driving circuit of claim 1, further comprising:
a ground connection; and
a switch coupled between the doubling capacitor and the ground connection.

4. The optical element driving circuit of claim 1, further comprising:
a trigger capacitor; and
a voltage control circuit coupled to the trigger capacitor and operable to prevent the trigger capacitor from charging above a selected voltage.

5. The optical element driving circuit of claim 4, further comprising:
charging circuitry operable to charge the illumination capacitor and the doubling capacitor without limitation by the voltage control circuit.

6. The optical element driving circuit of claim 1, further comprising:
a ground connection;
a trigger capacitor;
a first switch coupled between one of the doubling capacitor and the ground connection or the triggering capacitor and the doubling capacitor; and
a second switch coupled between the trigger capacitor and the ground connection;
wherein the control circuit comprises a trigger output coupled to the second switch and a voltage doubling output coupled to the first switch.

7. An optical element driving circuit comprising:
a first energy source exhibiting a first voltage;
a second energy source exhibiting the first voltage;
a switch operable to place the first energy source and second energy source in series;
a voltage doubling output coupled to the switch; and
a control circuit operative to distinguish between a high light mode and a low light mode and assert the voltage doubling output for the low light mode.

8. The optical element driving circuit of claim 7, further comprising:
an output selection input coupled to the control circuit, the output selection input operable to provide a selection signal to select between the high light mode and the low light mode.

9. The optical element driving circuit of claim 7, where the control circuit comprises:
an illumination control program stored in a memory.

10. The optical element driving circuit of claim 9, further comprising:
output intensity configuration data stored in the memory.

11. The optical element driving circuit of claim 9, further comprising:
a mapping stored in the memory, the mapping between output intensities and the high light mode and the low light mode.

12. The optical element driving circuit of claim 11, where the mapping comprises at least two selectable output intensities mapped to the high light mode.

13. The optical element driving circuit of claim 11, where the mapping comprises at least two selectable output intensities mapped to the low light mode.

14. The optical element driving circuit of claim 11, where the mapping comprises:
an approximately 15 candela output mapped to the low light mode;
an approximately 30 candela output mapped to the low light mode;
an approximately 75 candela output mapped to the high light mode; and
an approximately 110 candela output mapped to the high light mode.

15. A method for providing illumination, comprising:
charging a first energy source to a first voltage;
charging a second energy source to the first voltage;
determining whether to provide illumination in a high light mode or a low light mode;
de-asserting a voltage doubling input to a control circuit under the high light mode;
asserting the voltage doubling input to a control circuit under the low light mode;
receiving a trigger input; and
selectively driving a flash tube with the first energy source, or with the first energy source in series with the second energy source, in response to the trigger input.

16. The method of claim 15, where determining comprises:
receiving an output selection signal on an output selection input line.

17. The method of claim 15, where determining comprises:

determining a jumper position.

18. The method of claim 15, where determining comprises:

accessing a mapping between output intensities and the high light mode and the low light mode.

19. The method of claim 15, further comprising:

determining the first voltage based on a selected output intensity; and charging the first energy source and the second energy source to the first voltage.

20. An optical element driving circuit comprising:

an optical output element;

means for selecting an output intensity;

means for distinguishing between a high light mode and a low light mode based on the output intensity;

means for charging both a first energy source and a second energy source to a first voltage based on the output intensity;

means for selectively configuring a boost circuit in response to the output intensity into:

a first configuration driving the optical output element with the first energy source, but not the second energy source; and a second configuration driving the optical output element with the first and second energy sources in series.

21. An optical element driving circuit according to claim 20, further comprising:

means for generating a doubling input connected to the boost circuit.

22. An optical element driving circuit according to claim 21, further comprising:

means for mapping selected output intensities between the high light mode and the low light mode.

23. An optical element driving circuit according to claim 20, further comprising:

means for triggering the optical output element.

24. An optical element driving circuit according to claim 23, further comprising:

means for generating a trigger input to the optical output element.

25. An optical element driving circuit according to claim 23, further comprising:

means for controlling a trigger voltage on a trigger energy source to less than the first voltage.

* * * * *